US010465989B2

(12) United States Patent
Kimball et al.

(10) Patent No.: US 10,465,989 B2
(45) **Date of Patent: *Nov. 5, 2019**

(54) MARINE ENGINE HEAT EXCHANGER

(71) Applicant: Indmar Products Company Inc., Millington, TN (US)

(72) Inventors: Kevin J. Kimball, Mount Dora, FL (US); Rachel M. Mashburn, Memphis, TN (US); Jason C. Stimmel, Eads, TN (US); Jason Vetzel, Brighton, TN (US)

(73) Assignee: Indmar Products Company Inc., Millington, TN (US)

( * ) Notice: Subject to any disclaimer, the term of this patent is extended or adjusted under 35 U.S.C. 154(b) by 144 days.

This patent is subject to a terminal disclaimer.

(21) Appl. No.: 15/817,662

(22) Filed: Nov. 20, 2017

(65) Prior Publication Data

US 2018/0073810 A1 Mar. 15, 2018

Related U.S. Application Data

(63) Continuation of application No. 14/822,278, filed on Aug. 10, 2015, now Pat. No. 9,897,386.

(51) Int. Cl.

| | |
|---|---|
| ***F28D 7/08*** | (2006.01) |
| ***F28F 9/00*** | (2006.01) |
| ***F28F 9/22*** | (2006.01) |
| ***F28F 1/08*** | (2006.01) |
| ***F28D 1/02*** | (2006.01) |

(Continued)

(52) U.S. Cl.

CPC ..... *F28D 7/08* (2013.01); *F28D 1/022* (2013.01); *F28F 1/08* (2013.01); *F28F 9/001* (2013.01); *F28F 9/02* (2013.01); *F28F 9/22* (2013.01); *B63H 21/383* (2013.01)

(58) Field of Classification Search

CPC ..... F28D 7/08; F28D 7/0016; F28D 7/0033; F28D 7/082; F28D 7/085; F28D 1/022; F28F 1/08; F28F 1/10; F28F 1/105; F28F 1/14; F28F 1/16; F28F 1/24; F28F 1/26; F28F 1/34; F28F 9/001; F28F 9/002; F28F 9/007; F28F 9/0075; F28F 9/013; F28F 9/0131; F28F 9/02; F28F 9/22; F28F 9/24; F28F 2009/222–228; B63H 21/383

See application file for complete search history.

(56) References Cited

U.S. PATENT DOCUMENTS

| | | | |
|---|---|---|---|
| 745,186 A | 11/1903 | Hornbrook | |
| 2,513,124 A | 6/1950 | Weiks | |

(Continued)

FOREIGN PATENT DOCUMENTS

| | | | | |
|---|---|---|---|---|
| EP | 1093841 A1 * | 4/2001 | ..... | B01D 53/22 |
| JP | 2004232922 A * | 8/2004 | ..... | F28F 9/26 |

*Primary Examiner* — Cassey D Bauer
*Assistant Examiner* — Miguel A Diaz
(74) *Attorney, Agent, or Firm* — Wood, Herron & Evans, LLP

(57) ABSTRACT

A heat exchanger for a marine engine has a housing with an internal cavity. Twisted tubes snake back and forth inside the cavity and carry a first fluid to cool a second engine cooling fluid flowing through the cavity. Each of the twisted tubes has a plurality of ridges to increase the surface area of the tube exposed to the second fluid. Dividers inside the cavity direct the flow of the second fluid through the cavity. The housing may have a removable cover to access the housing cavity.

6 Claims, 9 Drawing Sheets

(51) Int. Cl.
*B63H 21/38* (2006.01)
*F28F 9/02* (2006.01)

(56) References Cited

U.S. PATENT DOCUMENTS 3,240,179 A 3/1966 Van Ranst
3,656,548 A 4/1972 Donaldson
3,830,289 A 8/1974 Olson
4,474,228 A 10/1984 Rogalski et al.
4,475,588 A * 10/1984 Tsou ..... F28F 9/22 165/159
5,004,042 A 4/1991 McMorries, IV et al.
5,327,957 A 7/1994 Killebrew
5,388,638 A 2/1995 Gentry
5,848,639 A 12/1998 Flesburg et al.
6,015,320 A 1/2000 Nanami
6,247,232 B1 6/2001 Lambert et al.
6,457,460 B1 10/2002 Doane et al.
6,544,085 B1 4/2003 Menard et al.
6,672,919 B1 1/2004 Beson
6,748,906 B1 6/2004 White et al.
6,988,919 B2 * 1/2006 Tanaka ..... B63H 21/14 440/88 C
8,137,146 B2 3/2012 Cohen
9,897,386 B2 2/2018 Kimball et al.
10,254,052 B2 * 4/2019 Sispera ..... F28F 1/00
2002/0144801 A1 10/2002 Gokan et al.
2002/0162648 A1 11/2002 Crook
2003/0153219 A1 * 8/2003 Menard ..... B63H 21/10 440/88 HE
2005/0230089 A1 10/2005 Ozaki
2009/0014151 A1 * 1/2009 Capelle ..... F28D 7/06 165/44
2009/0260784 A1 10/2009 Stikeleather
2009/0314481 A1 12/2009 Poorte
2009/0318039 A1 12/2009 Hays
2010/0084111 A1 4/2010 Jaeger et al.
2010/0181054 A1 7/2010 Nagurny et al.
2010/0276131 A1 * 11/2010 Barwig ..... F02B 29/0462 165/162
2011/0127022 A1 6/2011 Eller et al.
2011/0240252 A1 * 10/2011 Borski ..... F28F 9/002 165/51
2011/0240257 A1 * 10/2011 Piggott ..... F28D 1/05366 165/67
2011/0259040 A1 10/2011 Cataldo et al.
2012/0168142 A1 7/2012 Hernandez
2012/0292000 A1 * 11/2012 Khan ..... F28F 13/12 165/109.1
2012/0298343 A1 11/2012 Irmann-Jacobsen et al.
2013/0153171 A1 6/2013 Nagurny et al.
2013/0264037 A1 * 10/2013 Otsubo ..... F28D 7/085 165/157
2014/0020876 A1 1/2014 Rolland et al.
2014/0027099 A1 * 1/2014 Sispera ..... F28F 1/00 165/177
2014/0110094 A1 4/2014 Pagan Duran
2014/0158320 A1 6/2014 Archer et al.
2014/0182285 A1 * 7/2014 Jayakar ..... F28F 9/0268 60/605.1
2014/0262185 A1 * 9/2014 Raina ..... E04H 4/129 165/177
2014/0318737 A1 10/2014 Kaasa et al.
2014/0352302 A1 12/2014 Cho et al.
2015/0144322 A1 5/2015 Cooney
2016/0003550 A1 1/2016 Tokuda et al.
2016/0102922 A1 4/2016 Bourne
2016/0222761 A1 8/2016 Cain et al.
2016/0290742 A1 10/2016 Okimoto et al.
2017/0044968 A1 * 2/2017 Kimball ..... F28F 9/02
2017/0211895 A1 7/2017 Frechette et al.
2018/0086427 A1 * 3/2018 Stimmel ..... B63H 21/383
2018/0094880 A1 * 4/2018 Giachetti ..... F28F 9/0236

* cited by examiner

MARINE ENGINE HEAT EXCHANGER

CROSS REFERENCE TO RELATED APPLICATIONS

The present application is a continuation of U.S. patent application Ser. No. 14/822,278 filed Aug. 10, 2015, now U.S. Pat. No. 9,897,386, which is fully incorporated by reference herein.

FIELD OF THE INVENTION

The present invention relates to a heat exchanger for a marine internal combustion engine.

BACKGROUND OF THE INVENTION

In marine engine applications, heat exchangers using closed loop cooling systems are known. In such a system, the engine's cooling fluid, typically ethylene glycol or propylene glycol, passes through the engine where it is heated. The heated glycol then flows to a heat exchanger, where the glycol is cooled.

One method of cooling the engine's cooling fluid before it is recycled through the inside of the engine again, is to pass water, either salt or fresh water, from the waterway in which the boat is being used, to the heat exchanger. The water passes through a plurality of tubes in which the water is heated from the heated glycol. The heated water is then expelled or discharged back into the waterway from which it entered the tubes of the heat exchanger. The glycol is pumped into the heat exchanger and passed along a predetermined path inside the heat exchanger where the water filled tubes function to absorb the heat from the glycol. This reduces the temperature of the glycol to where it can reenter the engine and absorb heat from the engine again. This process repeats itself over and over.

U.S. Pat. No. 6,748,906 discloses a heat exchanger for a marine engine adapted to sit between opposed sides of a V-shaped internal combustion marine engine. Often, engine components are located between the opposed manifolds of a V-shaped internal combustion engine so the heat exchanger must be located in a different location.

The heat exchanger disclosed in U.S. Pat. No. 6,748,906 is cylindrical in shape. In many marine applications, a cylindrical-shaped heat exchanger is not practical due to size limitations. Therefore, it would be desirable to have a heat exchanger which is a different shape which may more easily fit into a marine environment.

Another drawback of known heat exchangers for use in marine engines is that they are not as efficient as desired. Therefore, a heat exchanger for use in a marine engine, which has increased efficiency due to increased surface area of the heat exchanger elements, would be desirable.

SUMMARY OF THE INVENTION

The present invention provides an improved heat exchanger for a marine engine. The heat exchanger comprises a housing shell having a cavity and threaded holes around the cavity. Twisted tubes are located inside the cavity for carrying a first fluid from one end of the heat exchanger to the other end. Each of the twisted tubes has a plurality of ridges made from the material of the tube to increase the surface area of the tube exposed to a second fluid passing through the heat exchanger. Dividers inside the cavity direct the flow of the second fluid through the cavity. The heat exchanger further comprises a housing cover, which may be removed to access the housing cavity. Threaded fasteners may extend through the cover and into threaded holes in the housing shell to open and/or close the heat exchanger.

The heat exchanger for a marine engine comprises a housing having a cavity and having a removable cover. Twisted tubes located inside the cavity carry a first fluid, each of said twisted tubes having a plurality of hollow continuous ridges to increase the surface area of the tube exposed to a second fluid flowing through the cavity in the opposite direction. Dividers inside the cavity direct the flow of the second fluid through the cavity.

The heat exchanger for a marine engine comprises a housing shell having a cavity and a cover adapted to be secured to the housing shell to close the cavity. The heat exchanger further comprises a first inlet port extending through an opening in the housing shell for introducing a first fluid into multiple twisted tubes inside the cavity. Each of the twisted tubes has a plurality of ridges made from the material of the tube to increase the surface area of the twisted tube exposed to a second fluid passing through the housing cavity. The heat exchanger further comprises a first outlet port for the first fluid extending through the housing shell, the outlet port being in fluid communication with the twisted tubes. The heat exchanger further comprises a second inlet port for introducing the second fluid into the cavity and a second outlet port for allowing the second fluid to exit the cavity. Lastly, the heat exchanger further comprises dividers inside the cavity which secure the twisted tubes in place.

To this end, and in accordance with principles of the present invention, the heat exchanger more efficiently transfers heat from the fluid passing over the twisted tubes to the fluid passing through the interiors of the twisted tubes due to increased surface area of the twisted tubes as compared to the surface area of conventional tubes.

By virtue of the foregoing, there is thus provided an improved heat transfer function between first and second fluids flowing through a heat exchanger for a marine engine. These and other objects and advantages of the present invention shall be made apparent from the accompanying drawings and the description thereof.

BRIEF DESCRIPTION OF THE DRAWINGS

The accompanying drawings, which are incorporated in and constitute a part of this specification, illustrate embodiments of the invention and, together with the general description of the invention given above and the detailed description of the embodiments given below, serve to explain the principles of the present invention.

DETAILED DESCRIPTION OF THE DRAWINGS

Figure 1:
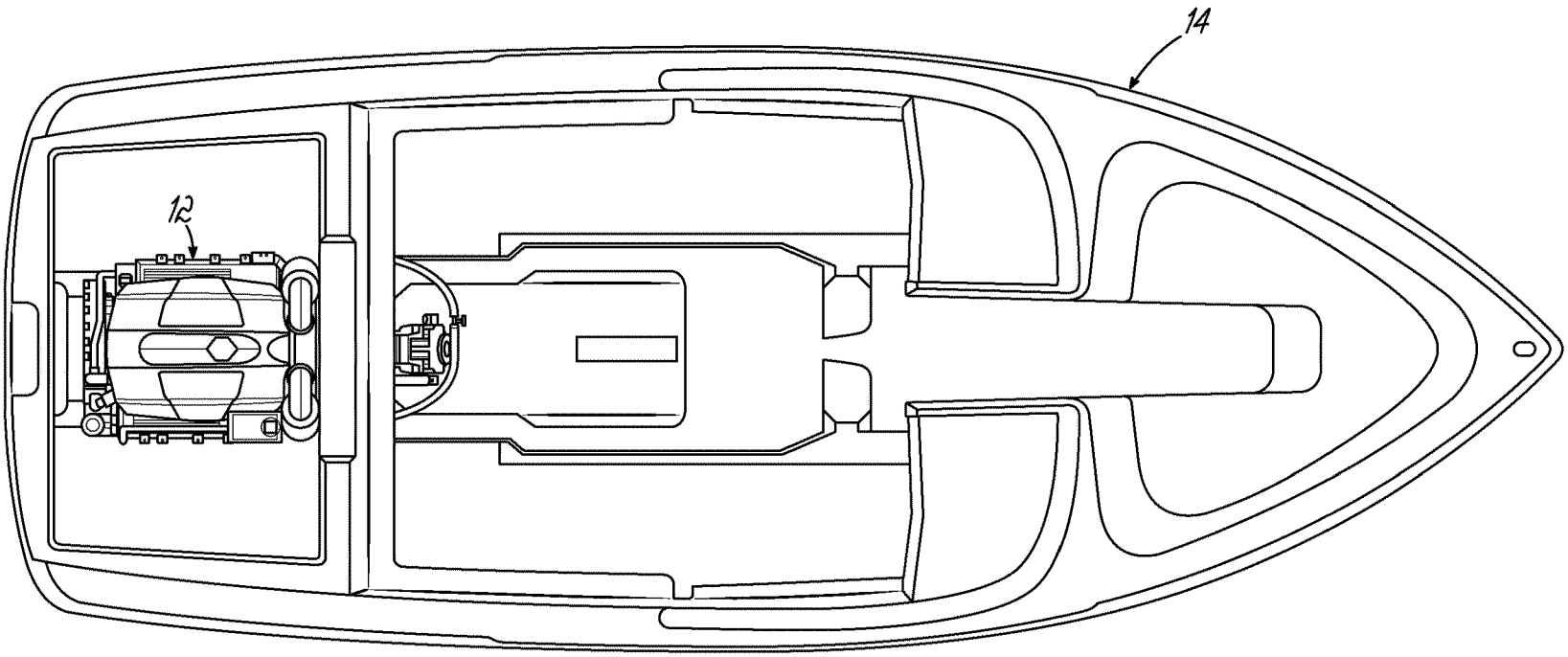
FIG. 1 is a top view of a motorboat with an internal combustion engine having a heat exchanger in accordance with the principles of the present invention.
Figure 2:
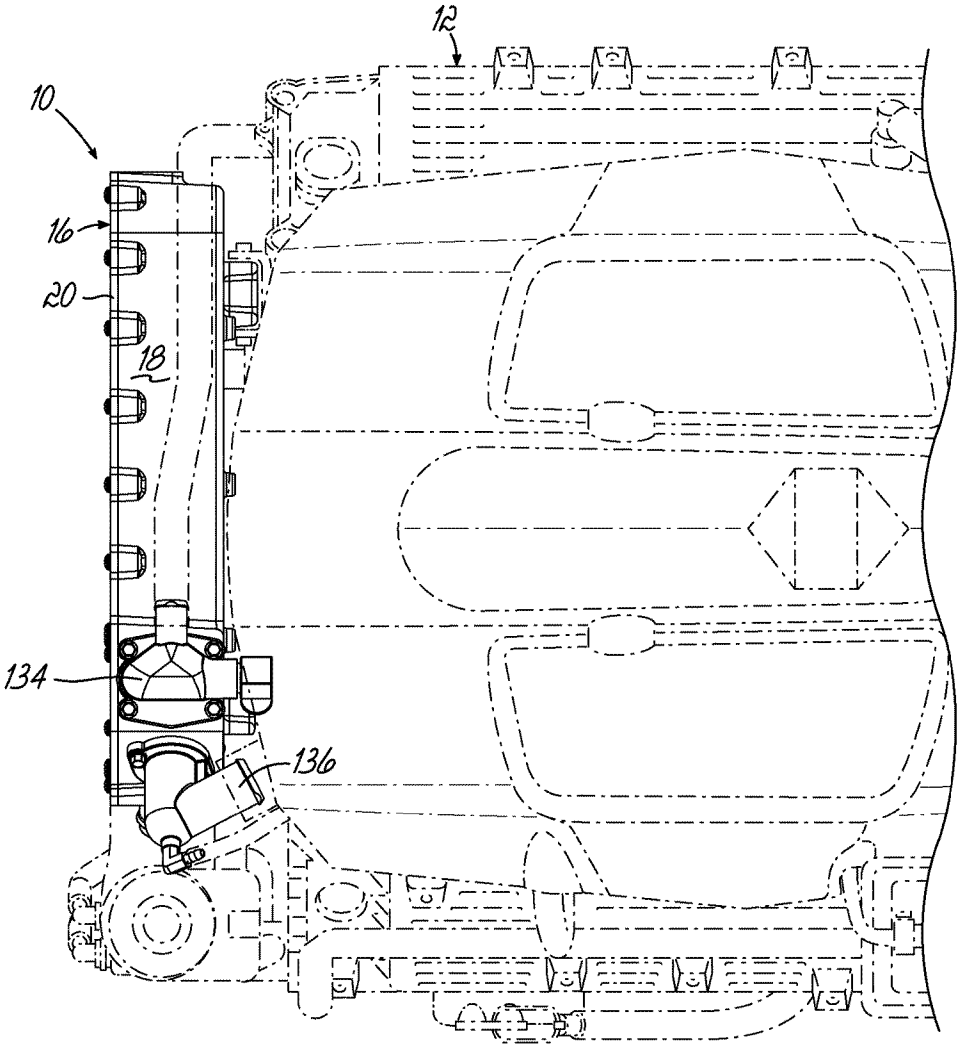
FIG. 2 is an enlarged top view of a portion of the internal combustion engine of FIG. 1.
Figure 3:
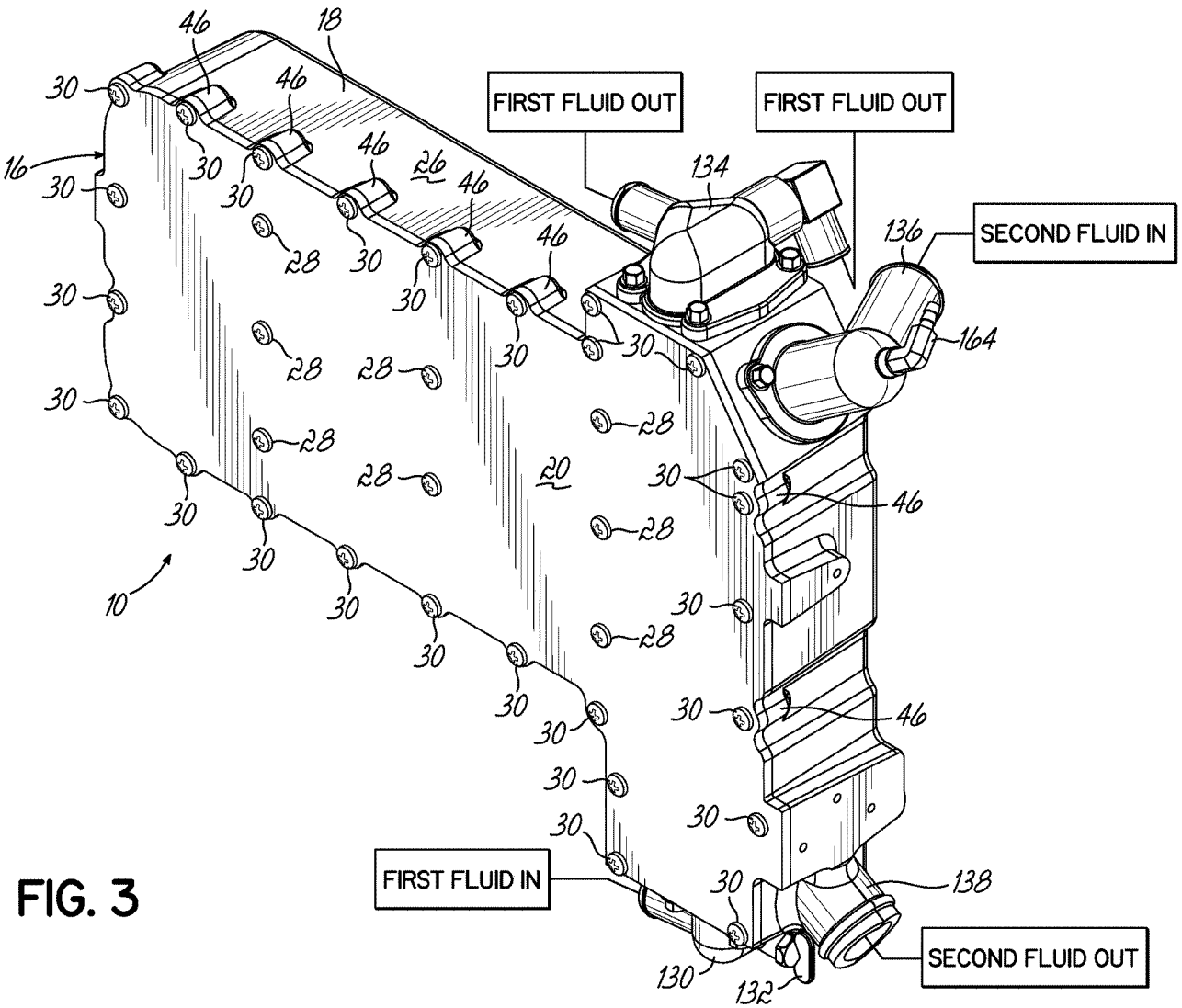
FIG. 3 is a rear perspective view of the heat exchanger used in the internal combustion engine of FIG. 1.

With reference to FIG. 3, there is shown a heat exchanger 10, constructed in accordance with the principles of the present invention. The heat exchanger 10 is intended for use with a marine engine 12 in a boat 14, but may be used in other environments. FIG. 1 illustrates the general position of the engine 12 in the boat 14, but is not intended to limit the type of engine 12 or type of boat 14 in which the heat exchanger 10 may be used.

Figure 4:
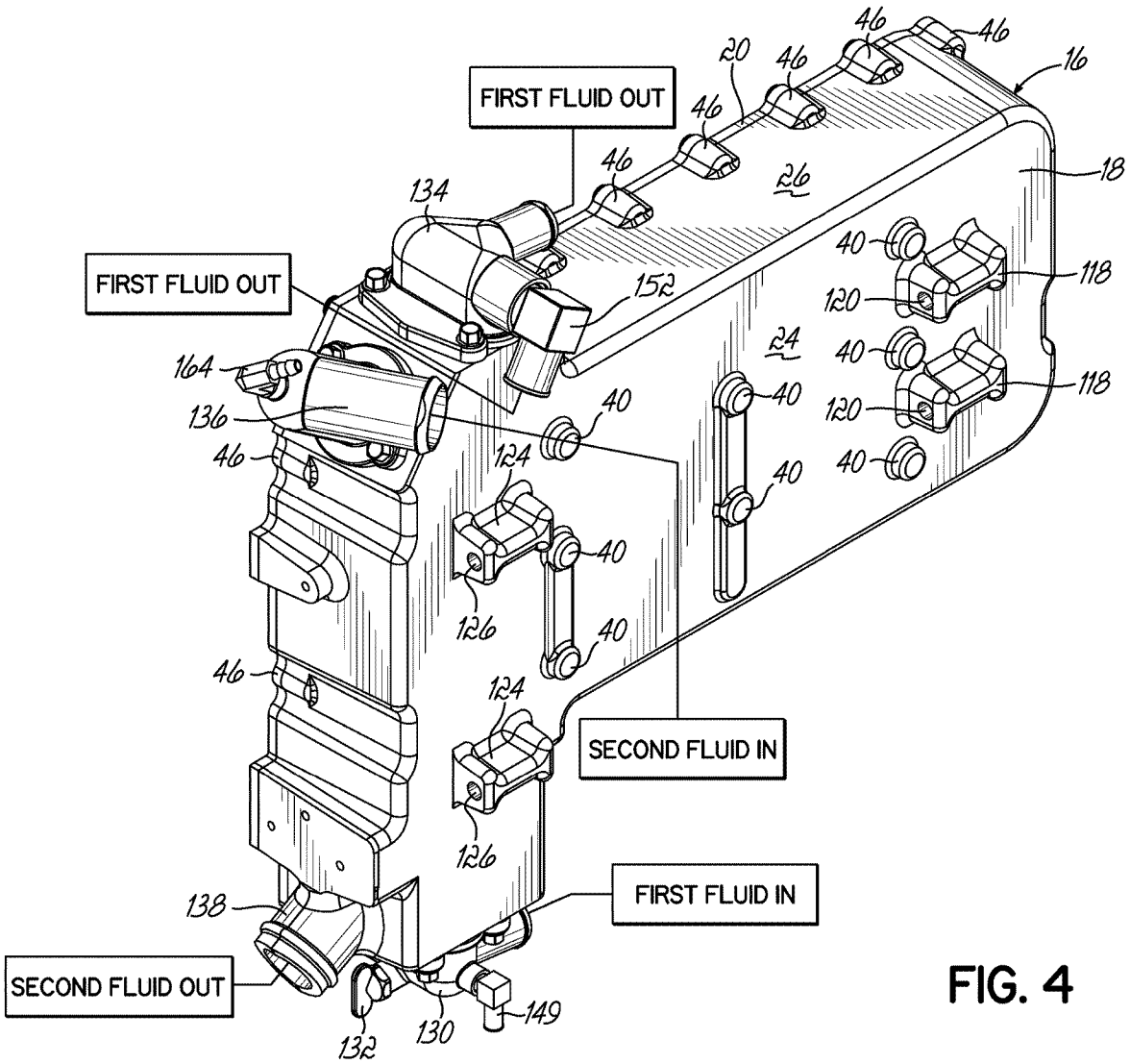
FIG. 4 is a front perspective view of the heat exchanger of FIG. 3.
Figure 5:
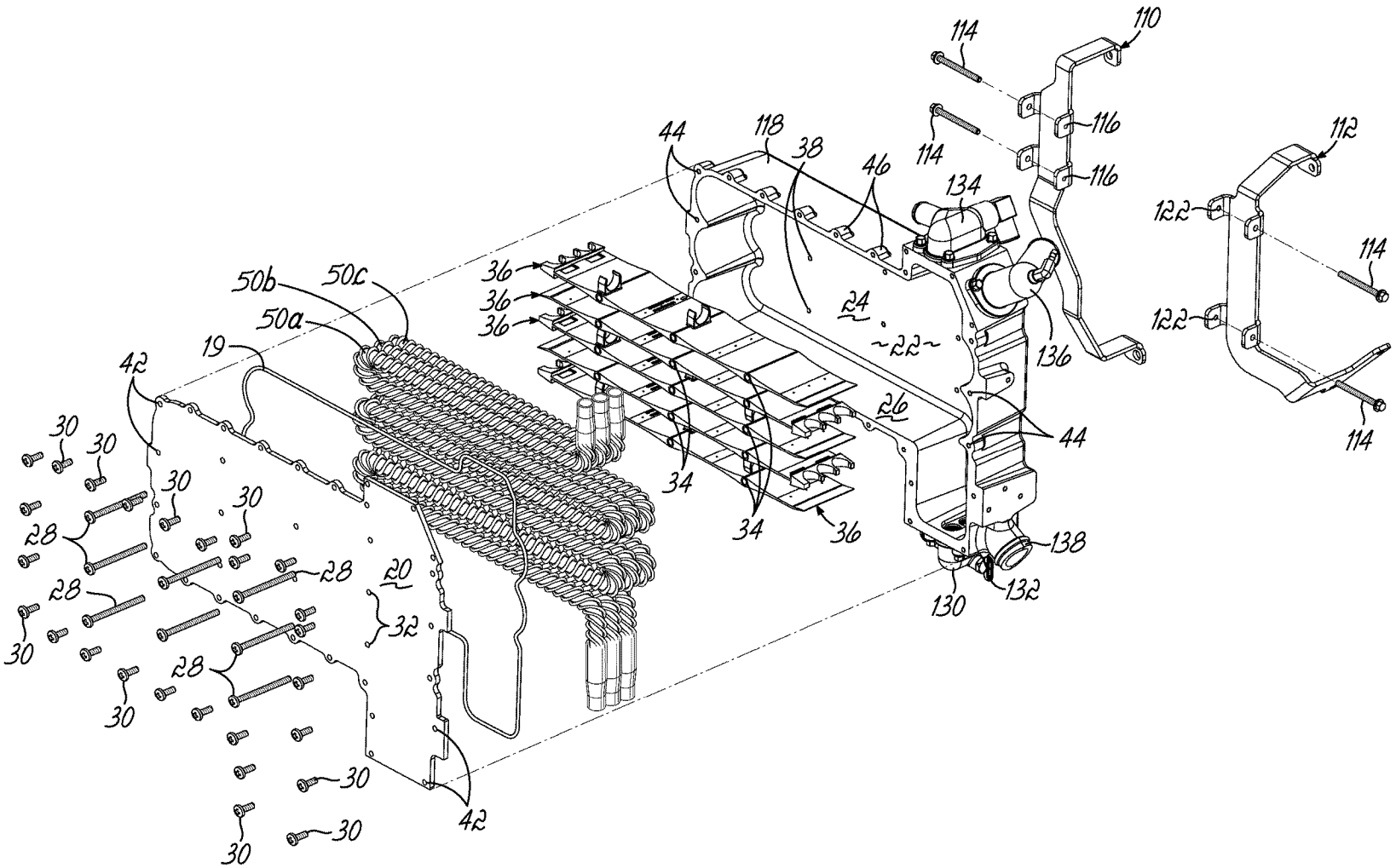
FIG. 5 is a partially disassembled view of the heat exchanger of FIG. 3.
Figure 6:
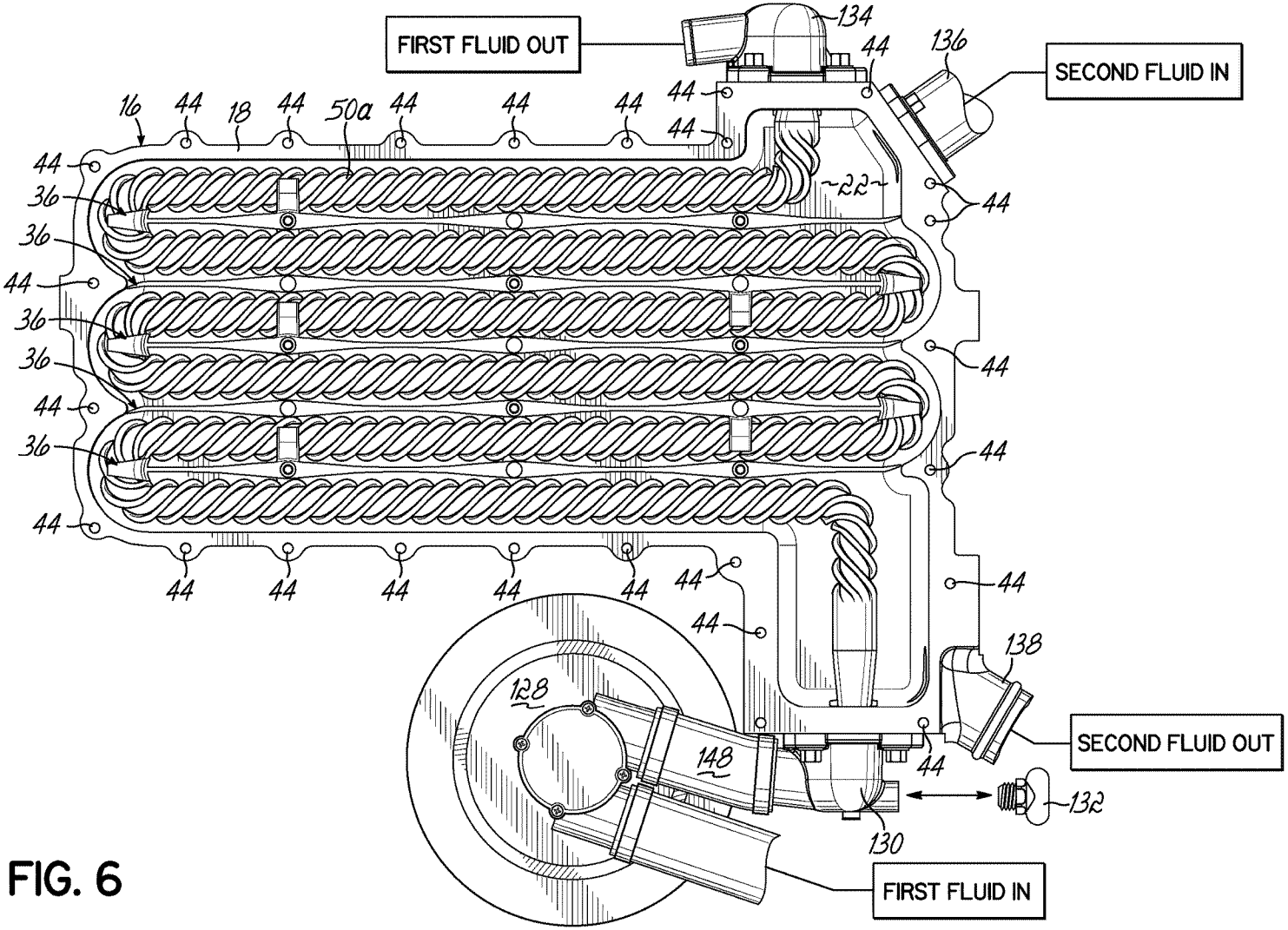
FIG. 6 is a cross-sectional view of the heat exchanger of FIG. 3.

FIGS. 3 and 4 illustrate opposed sides of the heat exchanger 10 in an assembled condition. As shown in FIG. 3, the heat exchanger 10 comprises a housing 16, including a housing shell 18 and a removable generally planar cover 20. The removable cover 20 of the heat exchanger 10 faces the rear of the boat 14. As shown in FIG. 5, a gasket 19 is attached to the removable cover 20. FIGS. 5 and 6 show the housing shell 18 having an interior cavity 22. As shown in FIG. 4, housing shell 18 has a front wall 24 and a continuous sidewall 26 extending generally around the perimeter of the housing 18 and being perpendicular to the front wall. In one embodiment, the housing shell 18 and cover 20 are made of cast aluminum; however, they may be made of any desired material, including plastic or metal and in any desired manner. Although one shape and size of the housing 16 is illustrated, those skilled in the art will appreciate that other sizes or shapes of housings may be utilized.

As best shown in FIGS. 3 and 4, the cover 20 is removably attached to the housing shell 18 with a plurality of internal and external threaded fasteners 28, 30, respectively. As shown in FIG. 5, the length of each of the internal threaded fasteners 28 is greater than the length of each of the external threaded fasteners 30.

As best shown in FIG. 5, each of the internal threaded fasteners 28 passes through an opening 32 in the housing cover 20, through one of the openings 34 in one of the dividers 36 and into a threaded opening 38 in the front wall 24 of the housing shell 18. As shown in FIG. 4, bosses 40 are located on the front wall 24 of the housing shell 18 to provide extra material to receive the ends of the internal threaded fasteners 28. As shown in FIG. 4, each of the bosses 40 extends forwardly away from the housing cover 20. As shown in FIG. 6, two internal threaded fasteners 28 extend through the outer two of three openings 34 in the top divider 36, and only one internal threaded fastener 28 extends through the middle of the three openings 34 in the next lowest divider 36. This pattern repeats itself for each of the five dividers 36 inside the cavity 22 of the housing 16. Although five dividers 36, each having three openings, are illustrated in heat exchanger 10, any number of dividers having any number of openings may be used in accordance with the present invention. Although eight internal threaded fasteners 28 are illustrated in heat exchanger 10, any number of fasteners may be used in accordance with the present invention. For example, an internal threaded fastener may pass through an opening in the housing cover, through each of the three openings of each divider 36 and be secured into a boss of a housing shell.

As best shown in FIG. 5, each of the external threaded fasteners 30 passes through an opening 42 around the perimeter of the housing cover 20 and into a threaded opening 44 located around the perimeter of the housing shell 18 without passing through one of the openings 34 in one of the dividers 36. As shown in FIGS. 3 and 4, bosses 46 are located around the perimeter of the housing shell 18 to provide extra material to receive the ends of the external threaded fasteners 30. Although twenty-six external threaded fasteners 30 are illustrated in heat exchanger 10, any number of them may be used in accordance with the present invention. Instead of using fasteners to removably secure the cover and the housing shell together, the cover may be welded or otherwise secured to the housing shell.

Figure 8:
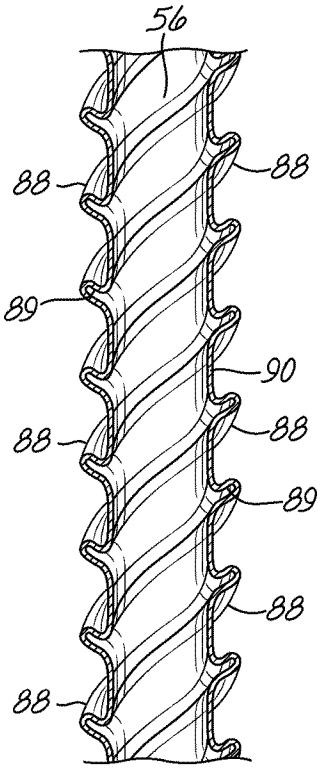
FIG. 8 is a cross-sectional view taken along the line 8-8 of FIG. 7.
Figure 7:
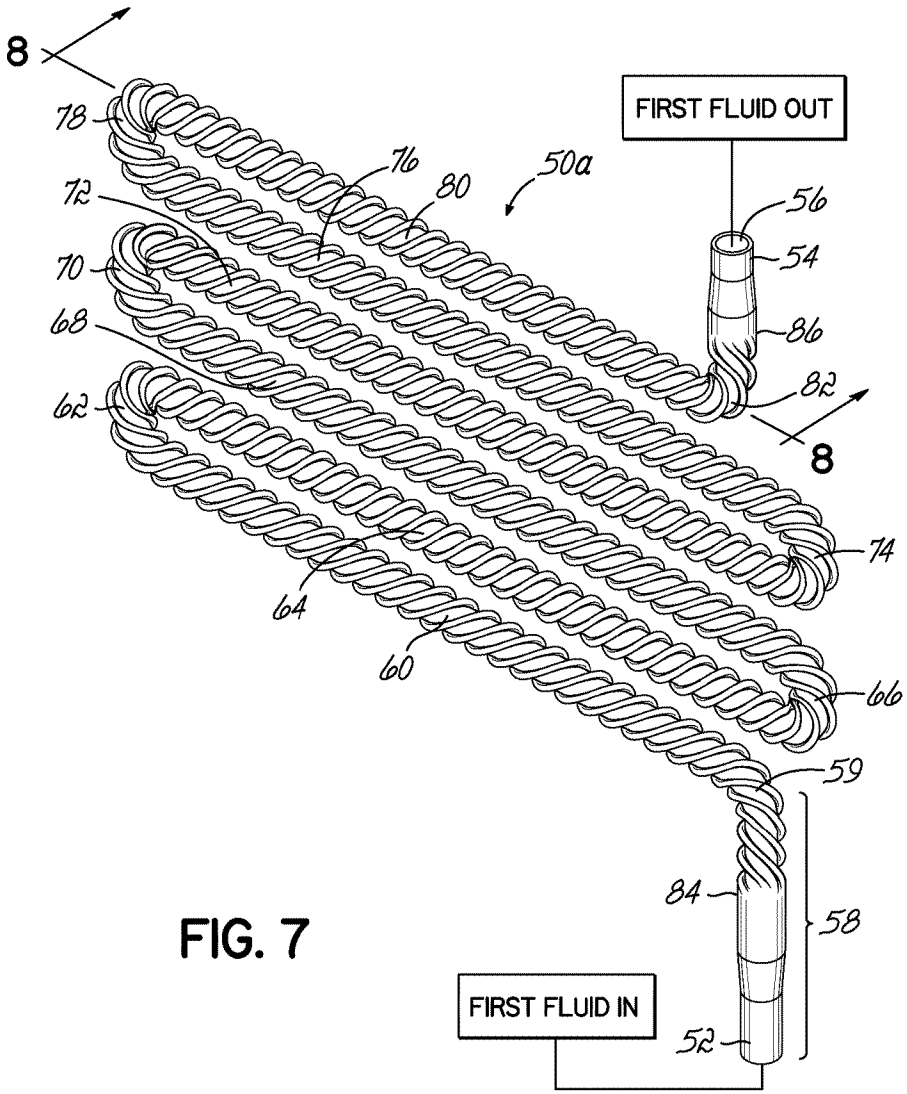
FIG. 7 is a perspective view of the twisted tube of the heat exchanger of FIG. 3.

As shown in FIGS. 5 and 6, three twisted tubes 50*a*, 50*b* and 50*c* are located inside the cavity 22 of the housing shell 18 and held in place with dividers 36. The dividers 36 are shown in detail in FIG. 5A and will be described below. Each twisted tube is identical; however, for simplicity, only twisted tube 50*a* is illustrated in FIGS. 7 and 8. As best shown in FIG. 5, twisted tube 50*a* is located closest to the removable cover 20, twisted tube 50*c* is located furthest from the removable cover 20, and twisted tube 50*b* is located between twisted tubes 50*a* and 50*c*. Although the drawings show three twisted tubes side-by-side, any number of twisted tubes may be used in accordance with the present invention.

Referring to FIG. 7, each twisted tube (only twisted tube 50*a* being shown) comprises an inlet 52 at the bottom of the twisted tube 50*a* and an outlet 54 with a hollow interior 56 throughout its length. From its inlet 52, twisted tube 50*a* extends upwardly along a length 58, then makes a ninety-degree bend at location 59 and extends sideways along a first generally horizontal portion 60 until it enters a first full bend 62, then extends sideways along a second generally horizontal portion 64 until it enters a second full bend 66. From the second full bend 66, twisted tube 50*a* extends sideways along a third generally horizontal portion 68 until it enters a third full bend 70 spaced above first full bend 62. From the third full bend 70, twisted tube 50*a* extends sideways along a fourth generally horizontal portion 72 until it enters a fourth full bend 74 spaced above second full bend 66. From the fourth full bend 74, twisted tube 50*a* extends sideways along a fifth generally horizontal portion 76 until it enters a fifth full bend 78 spaced above third full bend 70. From the fifth full bend 78, twisted tube 50*a* extends sideways along a sixth or top generally horizontal portion 80 until it enters a sixth and last ninety-degree bend 82 from which the twisted tube extends upwardly and ends at its outlet 54. Although each of the twisted tubes is illustrated having a certain configuration with a certain number of partial and full bends, the twisted tubes may have any number of full or partial bends and any number of straight or horizontal portions. This document is not intended to limit the configuration or orientation of the twisted tubes.

Referring to FIG. 7, from location 84 proximate inlet 52 until location 86 proximate outlet 54, twisted tube 50*a* has a twisted configuration with a plurality of continuous ridges 88 surrounding the tube body 90 and extending outwardly therefrom. As best shown in FIG. 8, each continuous ridge 88 has a hollow interior 89 and provides additional surface area exposed to and contacting the second fluid passing around the twisted tube 50*a* to increase heat transfer and increase the efficiency of the heat exchanger 10. The increased surface area of the twisted tubes transfers heat from the second fluid, commonly glycol passing through the interior of the engine, to the first fluid, water in most instances, to heat the first fluid and cool the second fluid. Each twisted tube 50*a*, 50*b*, 50*c* is preferably made of titanium in order to increase the strength of the twisted tube while reducing the wall thickness and hence, weight of the twisted tube. However, any one of the twisted tubes may be made of any desired material, such as copper, copper-nickel, stainless steel or a ceramic material, to name a few.

Figure 5A:
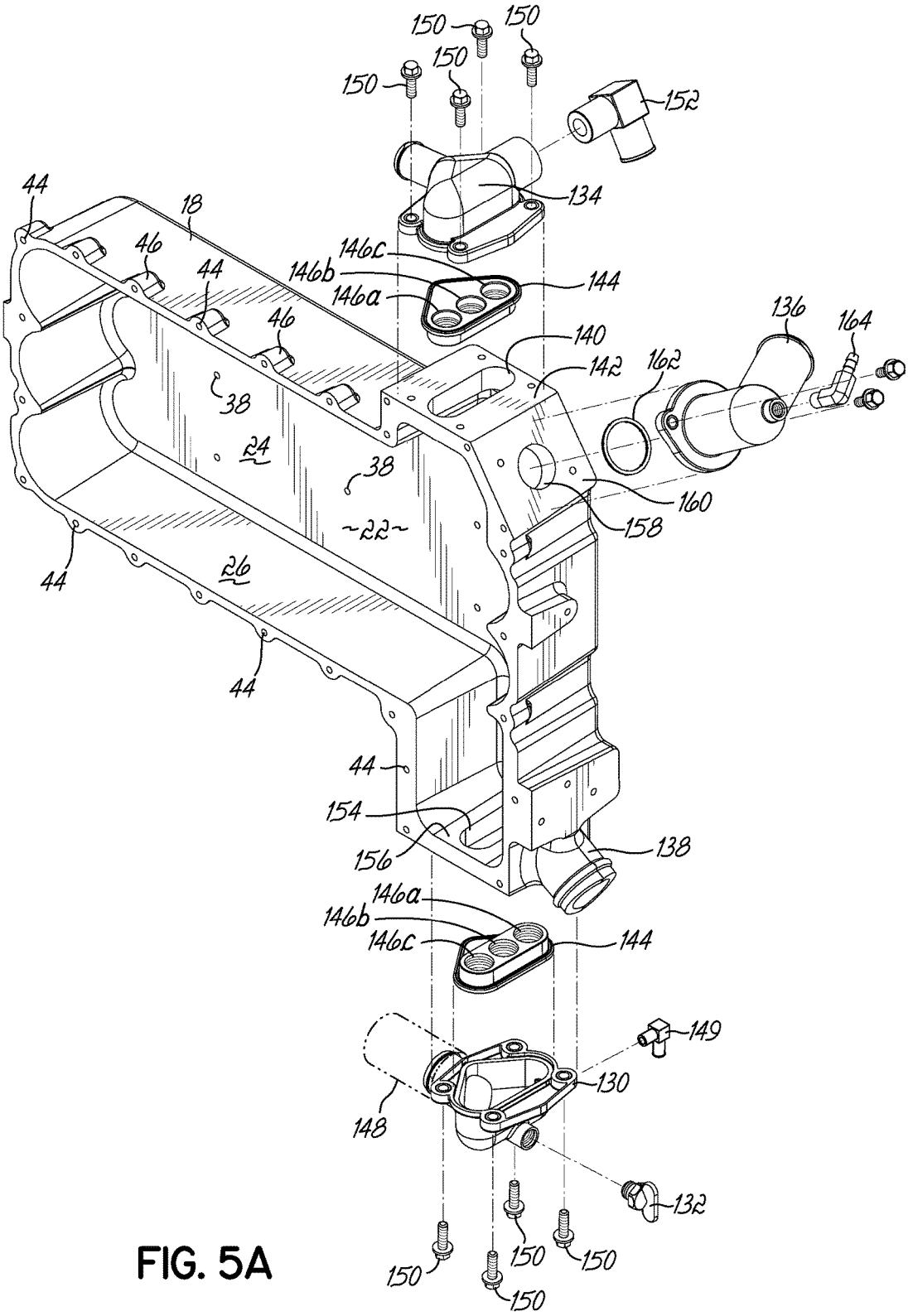
FIG. 5A is an enlarged view of a portion of the heat exchanger of FIG. 3.

As shown in FIG. 5, the heat exchanger 10 further comprises five dividers 36. All dividers 36 are identically configured, the two uppermost dividers 36 being shown in detail in FIG. 5B. Each of the dividers is shaped to release air from inside the housing to the top of the heat exchanger where the air exits via the air release fitting 164. As shown in FIG. 6, each divider 36 is located between an adjacent pair of horizontal portions of the twisted tubes 50*a*, 50*b* and 50*c*. Each divider 36 is held in place inside the cavity 22 of the housing 16 by at least one internal threaded fastener 28 passing through an opening 34 in the divider, as shown in FIG. 5A. Each divider 36 is preferably made of rubber in order to not damage the twisted tubes, but may be made of any desired material, including rubber-coated metal or a plastic material, to name a few.

Figure 5B:
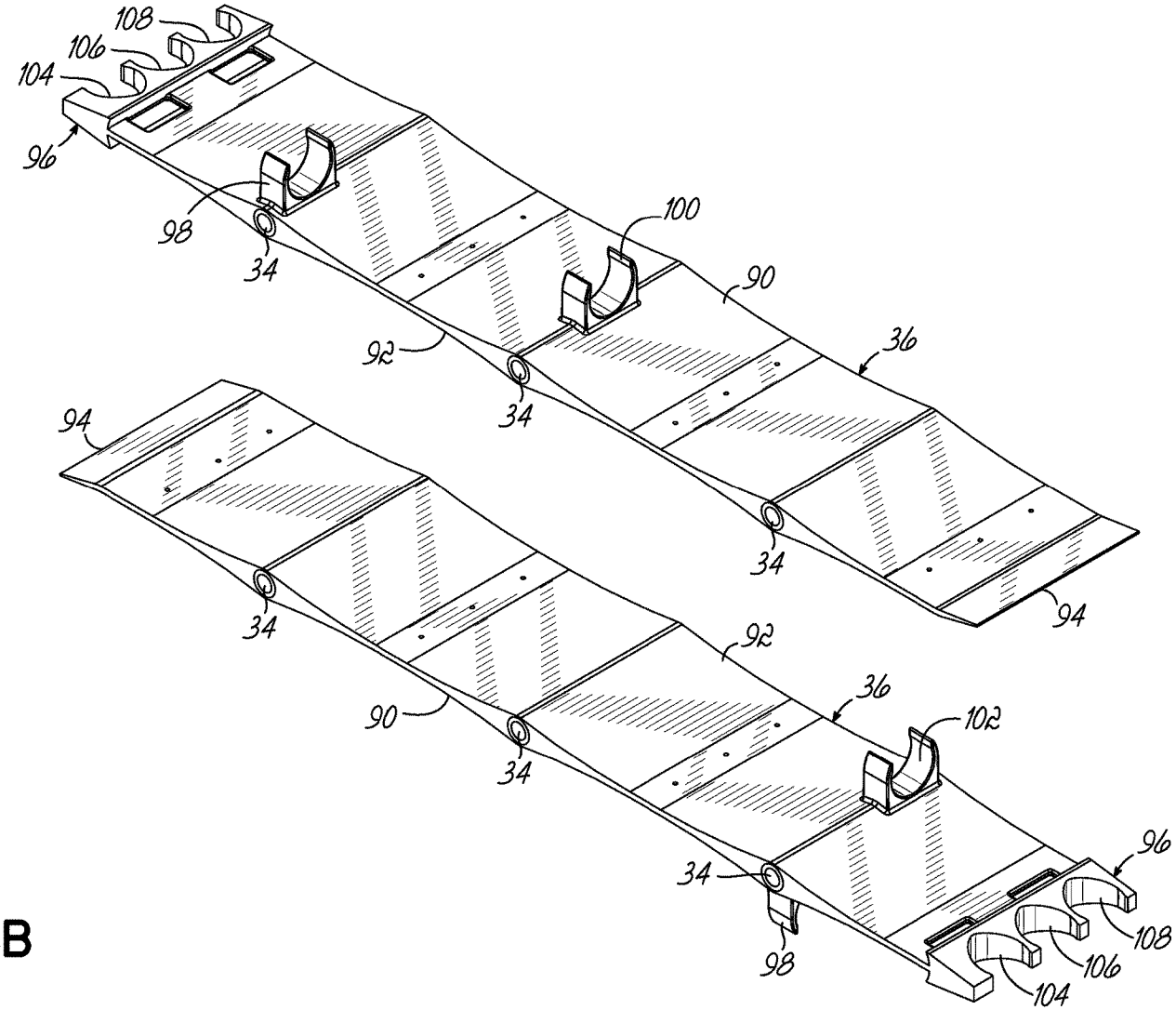
FIG. 5B is an enlarged view of the upper two dividers of the heat exchanger of FIG. 3.

As shown in FIG. 5B, each divider 36 is generally rectangular and has a first surface 90, a second surface 92, a flat end 94 and a holding end 96. The uppermost or top divider 36 is oriented such that the first surface 90 faces upwardly with the flat end on the right side of FIG. 5B. The next lowest divider 36 is identical to the top divider, but flipped relative to the top divider 36, such that its orientation is opposite the top divider 36, the first surface 90 facing downwardly and the holding end 96 on the right side of FIG. 5B. As shown in FIG. 5B, each divider 36 has first and second tube holders 98, 100 extending outwardly from the first surface 90 and a third tube holder 102 extending outwardly from the second surface 92. The first tube holder 98 holds and retains the uppermost or top generally horizontal portion 80 of twisted tube 50*a* closest to the cover 20 of the heat exchanger 10. The second tube holder 100 holds and retains the uppermost or top generally horizontal portion 80 of middle twisted tube 50*b*. The third tube holder 102 holds and retains the generally horizontal portion 76 of twisted tube 50*c*. Referring to FIG. 5B, the holding end 96 of the top divider 36 has three U-shaped retainers 104, 106, 108, the retainer 104 being closest to the cover 20 of the heat exchanger 10. As shown in FIG. 6, the first U-shaped retainer 104 retains the fifth full bend 78 of the twisted tube 50*a* closest to the cover 20 of the heat exchanger 10. The middle or second U-shaped retainer 106 retains the fifth full bend 78 of the twisted tube 50*b*. Lastly, the third U-shaped retainer 108 retains the fifth full bend 78 of the twisted tube 50*c*. Similarly, the holding end 96 of the next lowest divider 36 (the lowest divider 36 shown in FIG. 5B) has same three U-shaped retainers 104, 106, 108, the retainer 104 being closest to the cover 20 of the heat exchanger 10. The first U-shaped retainer 104 retains the fourth full bend 74 of the twisted tube 50*a* closest to the cover 20 of the heat exchanger 10. The middle or second U-shaped retainer 106 retains the fourth full bend 74 of the twisted tube 50*b*. Lastly, the third U-shaped retainer 108 retains the fourth full bend 74 of the twisted tube 50*c* farthest from the cover 20.

As shown in FIG. 5, the heat exchanger 10 further comprises first and second mounting brackets, 110, 112, respectively, for securing the heat exchanger 10 to the engine 12. The housing shell 18 is held onto the engine 12 with fasteners 114 which pass through tabs 116 in the first mounting bracket 110 and through mounting blocks 118 extending outwardly from the front wall 24 of the housing shell 18, as shown in FIG. 4. Each mounting block 118 fits between two aligned tabs 116 of the first mounting bracket 110 and has an opening 120 through which one of the fasteners 114 passes. Additional fasteners 114 pass through tabs 122 in the second mounting bracket 112 and through mounting blocks 124 extending outwardly from the front wall 24 of the housing shell 18, as shown in FIG. 4. Each mounting block 124 fits between two aligned tabs 122 of the second mounting bracket 112 and has an opening 126 through which one of the fasteners 114 passes. Although one configuration of mounting brackets is illustrated, other conventional means of mounting the heat exchanger to the engine may be used.

FIG. 5A illustrates an oval-shaped opening 140 extending through an upper flat 142 of the housing shell 18 into the interior cavity 22 of the housing shell 18. A seal 144 is adapted to fit inside the oval-shaped opening 140. The seal 144 has three openings 146*a*, 146*b* and 146*c*, each opening securing one of the outlets 54 of one of the twisted tubes 50*a*, 50*b* and 50*c*, respectively. An outlet port or cap 134 fits over the seal 144 and is secured to the upper flat 142 of the housing shell 18 with four fasteners 150. An elbow 152, made of nylon in one embodiment, is secured into one of the openings of the outlet port 134 to direct the flow of the first fluid passing through the outlets 54 of the twisted tubes 50*a*, 50*b* and 50*c* and through the outlet port 134.

FIG. 5A also illustrates an oval-shaped opening 154 extending through a lower flat 156 of the housing shell 18 into the interior cavity 22 of the housing shell 18. Another seal 144, identical to the one described above but flipped over, is adapted to fit inside the oval-shaped opening 154. The seal 144 has three openings 146*a*, 146*b* and 146*c*, each one holding one of the inlets 52 of one of the twisted tubes 50*c*, 50*b* and 50*a*, respectively. An inlet port or cap 130 fits over the seal 144 and is secured to the lower flat 156 of the housing shell 18 with four fasteners 150. A drain plug 132 is secured into one of the openings of the inlet port 130. The drain plug 132 may be removed to allow the first fluid to drain out of the twisted tubes 50*a*, 50*b* and 50*c* during the winter so the first fluid does not freeze inside the twisted tubes 50*a*, 50*b* and 50*c* of the heat exchanger 10 and damage them. A fitting 149 is secured to the inlet port 130. The hose 148 allows the first fluid to pass from a pump 128 into the inlet port 130, through the inlets 52 and then outlets 54 of all of the twisted tubes 50*a*, 50*b* and 50*c*, before the first fluid exits the first fluid outlet port 134.

FIG. 5A also illustrates a circular opening 158 extending through a corner flat 160 of the housing shell 18 into the interior cavity 22 of the housing shell 18. An inlet port 136 for the second fluid is adapted to fit inside the circular opening 158 with an O-ring 162 therebetween. An air release fitting 164 is secured to the inlet port 136 for the second fluid. Any one of the inlet and outlet ports of the heat exchanger may be made of any desired material, including metal or plastic.

In use, a first fluid, usually fresh or salt water, is pumped using pump 128 shown in FIG. 6 into inlet port 130 via a hose 148 which fits over a portion of inlet port 130. During operation, the first fluid flows upwardly through the twisted tubes 50*a*, 50*b* and 50*c*, past the first full bend, second full bend and so on until the first fluid exits outlet port 134 located at the top of the heat exchanger 10. The inlet and outlet ports for the first fluid, 130, 134 respectively, may be made of nylon, rubber, metal or plastic material or some combination thereof.

During operation of the marine engine 12, the second fluid, usually ethylene glycol or propylene glycol, enters the cavity 22 of the housing 16 via an inlet port 136. The second fluid flows downwardly, generally along the same path as the twisted tubes around the dividers 36 until the second fluid exits an outlet port 138 which is integral with the housing shell 18. The inlet port for the second fluid 136 may be made of aluminum or rubber or plastic material or some combination thereof. Although the outlet port 138 is illustrated being integrally formed with the housing shell 18, it is within the contemplation of the inventors that the outlet port for the second fluid may be a separate element attached to the housing shell with fasteners like the inlet port 136 of the second fluid. Similarly, the inlet port of the second fluid may be integrally formed with the housing shell, if desired. Alternatively, either the inlet or outlet port for the first fluid may be integrally formed with the housing shell, if desired.

By virtue of the foregoing, there is thus provided a heat exchanger which functions to more quickly and efficiently heat an engine coolant or second fluid.

While the present invention has been illustrated by the description of embodiments thereof, and while the embodiments have been described in considerable detail, it is not intended to restrict or in any way limit the scope of the appended claims to such detail. Additional advantages and modifications will readily appear to those skilled in the art. For example, the twisted tubes may be any desired diameter or length and have any number of bends. Likewise, any number of dividers may be used inside the heat exchanger to guide the direction of the engine cooling fluid. The invention in its broader aspects is, therefore, not limited to the specific details, representative apparatus and method, and illustrative examples shown and described. Accordingly, departures may be made from such details without departing from the spirit or scope of the general inventive concept.

Having described the invention, what is claimed is:

1. A heat exchanger for a marine engine, the heat exchanger comprising:

a housing shell having a front wall having mounting blocks formed therein, a continuous sidewall having multiple openings and an interior cavity;

twisted tubes inside the interior cavity of the housing shell for carrying a first liquid, each of said twisted tubes having a twisted configuration with a tube body and a plurality of hollow, continuous ridges surrounding the tube body and extending outwardly from the tube body to increase a surface area of the twisted tube;

dividers inside the interior cavity to direct the flow of a second liquid through the interior cavity;

inlet and outlet ports for the first liquid secured to the continuous sidewall of the housing shell, each of the inlet and outlet ports for the first liquid covering one of the openings extending through the continuous sidewall of the housing shell;

inlet and outlet ports for the second liquid;

a removable housing cover secured to the housing shell; and mounting brackets for securing the heat exchanger to the marine engine with fasteners extending through tabs in the mounting brackets and through the mounting blocks of the front wall of the housing shell, wherein at least one of the dividers is held in place in the interior cavity by at least one threaded fastener extending through the removable cover of the housing, through an opening in the divider and into a boss formed in the front wall of the housing shell.

2. The heat exchanger of claim 1, wherein each of the dividers is held in place in the interior cavity by multiple threaded fasteners.

3. The heat exchanger of claim 1 wherein the cavity contains three twisted tubes.

4. The heat exchanger of claim 1 wherein the first liquid is water and the second liquid is ethylene glycol.

5. The heat exchanger of claim 1 wherein the twisted tubes are made of titanium.

6. The heat exchanger of claim 1 wherein the dividers are made of rubber and have multiple tube holders.

* * * * *